US007462258B2

(12) United States Patent
Tirimacco et al.

(10) Patent No.: US 7,462,258 B2
(45) Date of Patent: Dec. 9, 2008

(54) PAPER TOWEL WITH SUPERIOR WIPING PROPERTIES

(75) Inventors: Maurizio Tirimacco, Appleton, WI (US); Mike Thomas Goulet, Neenah, WI (US); Michael William Veith, Fremont, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 650 days.

(21) Appl. No.: 11/171,969

(22) Filed: Jun. 29, 2005

(65) Prior Publication Data

US 2007/0000629 A1 Jan. 4, 2007

(51) Int. Cl.
*B31F 1/12* (2006.01)
*D21H 23/24* (2006.01)

(52) U.S. Cl. ..... 162/112; 162/123; 162/158; 162/168.1; 162/135; 428/153; 428/172; 428/195.1

(58) Field of Classification Search ..... 162/109, 162/111–113, 123–137, 158, 164.1, 168.1, 162/179, 169; 428/152–153, 156, 172, 195.1; 424/402

See application file for complete search history.

(56) References Cited

U.S. PATENT DOCUMENTS

| | | | | | |
|---|---|---|---|---|---|
| 3,879,257 | A * | 4/1975 | Gentile et al. | ..... | 162/112 |
| 3,903,342 | A * | 9/1975 | Roberts, Jr. | ..... | 428/153 |
| 4,000,237 | A * | 12/1976 | Roberts, Jr. | ..... | 264/128 |
| 4,096,311 | A | 6/1978 | Pietreniak | | |
| 4,125,659 | A * | 11/1978 | Klowak et al. | ..... | 428/153 |
| 4,208,459 | A * | 6/1980 | Becker et al. | ..... | 428/154 |
| 4,326,000 | A * | 4/1982 | Roberts, Jr. | ..... | 428/153 |
| 4,919,877 | A | 4/1990 | Parsons et al. | | |
| 5,316,601 | A | 5/1994 | Hebbard et al. | | |
| 5,387,207 | A | 2/1995 | Dyer et al. | | |
| 5,476,711 | A | 12/1995 | Hebbard et al. | | |
| 5,776,306 | A | 7/1998 | Hepford | | |
| 5,843,063 | A | 12/1998 | Anderson et al. | | |
| 5,989,682 | A * | 11/1999 | Anderson | ..... | 428/152 |
| 6,103,061 | A | 8/2000 | Anderson et al. | | |
| 6,129,815 | A * | 10/2000 | Larson et al. | ..... | 162/112 |
| 6,187,140 | B1 * | 2/2001 | Anderson et al. | ..... | 162/112 |
| 6,315,864 | B2 | 11/2001 | Anderson et al. | | |
| 6,500,289 | B2 * | 12/2002 | Merker et al. | ..... | 156/183 |
| 6,846,383 | B2 * | 1/2005 | Tirimacco | ..... | 162/112 |
| 6,887,350 | B2 * | 5/2005 | Garnier et al. | ..... | 162/135 |
| 7,189,307 | B2 * | 3/2007 | Goulet et al. | ..... | 162/127 |
| 7,229,529 | B2 * | 6/2007 | Goulet et al. | ..... | 162/127 |
| 7,297,231 | B2 * | 11/2007 | Goulet et al. | ..... | 162/168.1 |
| 7,361,253 | B2 * | 4/2008 | Tirimacco | ..... | 162/112 |
| 2001/0008180 | A1 * | 7/2001 | Anderson et al. | ..... | 162/111 |
| 2002/0117280 | A1 | 8/2002 | Howle et al. | | |
| 2004/0007339 | A1 * | 1/2004 | Tirimacco | ..... | 162/112 |
| 2004/0031578 | A1 * | 2/2004 | Tirimacco | ..... | 162/111 |
| 2004/0118544 | A1 * | 6/2004 | Tirimacco et al. | ..... | 162/204 |
| 2004/0192136 | A1 | 9/2004 | Gusky et al. | | |
| 2004/0234804 | A1 | 11/2004 | Liu et al. | | |
| 2005/0045293 | A1 | 3/2005 | Hermans et al. | | |
| 2005/0045294 | A1 | 3/2005 | Goulet et al. | | |
| 2005/0045295 | A1 | 3/2005 | Goulet et al. | | |
| 2005/0145352 | A1 | 7/2005 | Hermans et al. | | |
| 2005/0148257 | A1 | 7/2005 | Hermans et al. | | |
| 2006/0014884 | A1 | 1/2006 | Goulet et al. | | |
| 2006/0086472 | A1 | 4/2006 | Hermans et al. | | |
| 2007/0000629 | A1 * | 1/2007 | Tirimacco et al. | ..... | 162/109 |
| 2008/0006382 | A1 * | 1/2008 | Goulet et al. | ..... | 162/168.1 |

FOREIGN PATENT DOCUMENTS

| | | | |
|---|---|---|---|
| GB | 2 324 317 | A | 10/1998 |
| WO | WO 03/037960 | A1 | 5/2003 |
| WO | WO 2004005015 | A3 * | 1/2004 |
| WO | WO 2005/066415 | A1 | 7/2005 |
| WO | WO 20060019459 | A1 | 2/2006 |
| WO | WO 2007005083 | A2 * | 1/2007 |

OTHER PUBLICATIONS

Espy, Herbert H., "Alkaling-Curing Polymeric Amine-Epichlorohydrin Resins," *Wet-Strength Resins and Their Application,* edited by Lock L. Chan, Chapter 2, TAPPI Press, Atlanta, GA, 1994, pp. 14-44.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

* cited by examiner

*Primary Examiner*—José A Fortuna
(74) *Attorney, Agent, or Firm*—Gregory E. Croft

(57) ABSTRACT

Paper towels are produced by printing a binder material, such as certain latex binders, onto one side of a basesheet and creping the binder-treated sheet. The resulting products have exceptional wipe dry properties and a unique pore structure and wicking properties.

21 Claims, 7 Drawing Sheets

PAPER TOWEL WITH SUPERIOR WIPING PROPERTIES

BACKGROUND OF THE INVENTION

Paper towels have a variety of uses, but absorbing liquids and wiping surfaces clean are primary applications. As a result, absorbent properties of paper towels are especially important. Absorbent capacity and absorbent rate are two properties most commonly addressed, but these properties do not necessarily reflect towel performance during wiping applications. For such wiping applications, a "wipe dry" test, which reflects the ability of a towel to wipe water from a surface, is a better measure of performance. While a number of commercially available paper towels exhibit relatively good wipe dry properties, there is always a need for improvement.

SUMMARY OF THE INVENTION

It has been found that paper towels with improved wipe dry performance can be made by applying a binder material to a surface of a throughdried basesheet, particularly an uncreped throughdried basesheet, such as by printing or spraying, and thereafter creping the binder-treated side of the basesheet. (As used herein, the side of a sheet placed in contact with the creping cylinder during creping is the creped side of the sheet.) The resultant binder-treated/creped sheet can be used as a single-ply paper towel product, or it can be plied together with a like sheet to produce a two-ply paper towel product, for household and/or industrial uses. While not being bound by theory, the topical binder and the underlying throughdried sheet structure of the paper towels of this invention combine to deliver a hydrophilic surface and capillary wicking gradient/distribution that results in superior liquid wiping properties. In addition, such towels exhibit consumer-differentiated performance when wiping up spills as compared to other towels with and without topical binders.

Hence, in one aspect, the invention resides in a paper towel having an average wipe dry test value (hereinafter defined) of about 900 square centimeters or greater. More specifically, the wipe dry test value can be from about 900 to about 1000 square centimeters, still more specifically from about 900 to about 950 square centimeters. When printing is used as the means for applying the binder material to the towel basesheet, the binder-treated side of the resulting sheet is sometimes referred to as being "print/creped". It has been found that the wipe dry test values for the print/creped side of the treated sheet are higher than the values for the opposite side of the sheet. Hence, two-ply paper towels of this invention can have an average wipe dry test value which is higher than the wipe dry test value of a single-ply product since the higher wipe dry sides can be plied outwardly.

In another aspect, the invention resides in a paper towel having a pore structure characterized by a grams of water per gram of product saturation of about 1.0 or greater for pores having an equivalent pore radius of about 100 microns or less, as determined by the vertical wicking test (hereinafter described). More specifically, the grams of water per gram of product saturation can be about 2.0 or greater for pores having an equivalent pore radius of about 100 microns or less and, still more specifically, from about 0.3 to about 2.0 for pores having an equivalent pore radius from about 80 to about 100 microns. Stated differently, the paper towels of this invention have a pore structure capable of absorbing at least 0.3 grams of water per gram of product against a negative hydrostatic tension of about 16 centimeters of water, as determined by the vertical wicking test, more specifically at least 1.0 gram of water per gram of product against a negative hydrostatic tension of about 15 centimeters of water, and still more specifically at least 1.5 grams of water per gram of product against a negative hydrostatic tension of about 14 centimeters of water.

The paper towels of this invention can be further characterized by various other properties (hereinafter defined) in combination with one or both of the wipe dry and vertical wicking values mentioned above. More specifically, the stack bulk can be about 10 cubic centimeters or greater per gram, more specifically from about 10 to about 20 cubic centimeters per gram, and still more specifically from about 10 to about 15 cubic centimeters per gram.

The machine direction (MD) tensile strength can be about 1200 grams or greater per 7.62 centimeters (3 inches), more specifically from about 1200 to about 3000 grams per 7.62 centimeters, more specifically from about 1500 to about 2000 grams per 7.62 centimeters.

The MD stretch can be about 20 percent or greater, more specifically from about 25 to about 45 percent, and still more specifically from about 30 to about 40 percent.

The MD TEA can be about 30 gram-centimeters per square centimeter or greater, more specifically from about 30 to about 55 gram-centimeters per square centimeter, and still more specifically from about 40 to about 50 gram-centimeters per square centimeter.

The MD slope can be about 10 kilograms or less, more specifically from about 3 to about 10, more specifically from about 3 to about 5, and still more specifically from about 4 to about 4.5.

The cross-machine direction (CD) tensile strength can be about 1000 grams or greater per 7.62 centimeters (3 inches), more specifically from about 1000 to about 2000 grams per 7.62 centimeters, more specifically from about 1200 to about 1500 grams per 7.62 centimeters.

The CD stretch can be about 10 percent or greater, more specifically from about 10 to about 25 percent, and still more specifically from about 15 to about 20 percent.

The CD TEA can be about 20 gram-centimeters per square centimeter or greater, more specifically from about 20 to about 30 gram-centimeters per square centimeter, and still more specifically from about 20 to about 25 gram-centimeters per square centimeter.

The CD slope can be about 10 kilograms or less, more specifically from about 3 to about 10, more specifically from about 4 to about 8, and still more specifically from about 6 to about 7.

The CD wet tensile strength can be about 600 grams or greater per 7.62 centimeters (3 inches), more specifically from about 600 to about 1000 grams per 7.62 centimeters, more specifically from about 650 to about 800 grams per 7.62 centimeters.

The CD wet stretch can be about 10 percent or greater, more specifically from about 10 to about 15 percent, more specifically from about 13 to about 14 percent.

A particularly suitable class of binder materials useful for purposes of this invention include an unreacted mixture of an azetidinium-reactive polymer and an azetidinium-functional cross-linking polymer, wherein the amount of the azetidinium-functional cross-linking polymer relative to the amount of the azetidinium-reactive polymer is from about 0.5 to about 25 dry weight percent on a solids basis.

Azetidinium-reactive polymers suitable for use in accordance with this invention are those polymers containing functional pendant groups that will react with azetidinium-functional molecules. Such reactive functional groups include carboxyl groups, amines and others. Particularly suitable azetidinium-reactive polymers include carboxyl-functional latex emulsion polymers. More particularly, carboxyl-functional latex emulsion polymers useful in accordance with this invention can comprise aqueous emulsion addition copolymerized unsaturated monomers, such as ethylenic monomers, polymerized in the presence of surfactants and initiators to produce emulsion-polymerized polymer particles. Unsaturated monomers contain carbon-to-carbon double bond unsaturation and generally include vinyl monomers, styrenic monomers, acrylic monomers, allylic monomers, acrylamide monomers, as well as carboxyl functional monomers. Vinyl monomers include vinyl esters such as vinyl acetate, vinyl propionate and similar vinyl lower alkyl esters, vinyl halides, vinyl aromatic hydrocarbons such as styrene and substituted styrenes, vinyl aliphatic monomers such as alpha olefins and conjugated dienes, and vinyl alkyl ethers such as methyl vinyl ether and similar vinyl lower alkyl ethers. Acrylic monomers include lower alkyl esters of acrylic or methacrylic acid having an alkyl ester chain from one to twelve carbon atoms as well as aromatic derivatives of acrylic and methacrylic acid. Useful acrylic monomers include, for instance, methyl, ethyl, butyl, and propyl acrylates and methacrylates, 2-ethyl hexyl acrylate and methacrylate, cyclohexyl, decyl, and isodecyl acrylates and methacrylates, and similar various acrylates and methacrylates.

The carboxyl-functional latex emulsion polymer can contain copolymerized carboxyl-functional monomers such as acrylic and methacrylic acids, fumaric or maleic or similar unsaturated dicarboxylic acids, where the preferred carboxyl monomers are acrylic and methacrylic acid. The carboxyl-functional latex polymers comprise by weight from about 1% to about 50% copolymerized carboxyl monomers with the balance being other copolymerized ethylenic monomers. Preferred carboxyl-functional polymers include carboxylated vinyl acetate-ethylene terpolymer emulsions such as Airflex® 426 Emulsion, commercially available from Air Products Polymers, LP.

Suitable azetidinium-functional cross-linking polymers include polyamide-epichlorohydrin (PAE) resins, polyamide-polyamine-epichlorohydrin (PPE) resins, polydiallylamine-epichlorohydrin resins and other such resins generally produced via the reaction of an amine-functional polymer with an epihalohydrin. Many of these resins are described in the text "Wet Strength Resins and Their Applications", chapter 2, pages 14-44, TAPPI Press (1994), herein incorporated by reference. The relative amounts of the azetidinium-reactive polymer and the azetidinium-functional cross-linking polymer will depend on the number of functional groups (degree of functional group substitution on molecule) present on each component. In general, it has been found that properties desirable for a disposable paper towel, for example, are achieved when the level of azetidinium-reactive polymer exceeds that of the azetidinium-functional cross-linking polymer on a dry solids basis. More specifically, on a dry solids basis, the amount of azetidinium-functional cross-linking polymer relative to the amount of azetidinium-reactive polymer can be from about 0.5 to about 25 weight percent, more specifically from about 1 to about 20 weight percent, still more specifically from about 2 to about 10 weight percent and still more specifically from about 5 to about 10 weight percent.

Other suitable binder materials include polymeric binders derived from ethylene vinylacetate copolymers and derivatives thereof. The ethylene vinylacetate copolymers can be delivered in any form, particularly including latex emulsions. Particular examples of latex binder materials that can be used for purposes of this invention include Airflex® 426, Airflex® 410 and Airflex® EN1165 sold by Air Products Inc. or ELITE® PE BINDER available from National Starch. It is believed that all of the foregoing binder materials are ethylene/vinylacetate copolymers. Other suitable binder materials include, without limitation, polyvinyl chloride, styrene-butadiene, polyurethanes, modified versions of the foregoing materials, and the like. Suitable means for applying the binder material include spraying and printing. The binder materials can optionally be crosslinkable and capable of forming covalent crosslinks with themselves, with cellulose, or with both themselves and cellulose. Without limitation, suitable crosslinking groups include n-methylol acrylamide, epoxy, aldehyde, anhydride and the like. A specific crosslinking binder material suitable for purposes of this invention is Airflex® EN1165 sold by Air Products. This binder is believed to be an ethylene/vinylacetate copolymer containing n-methylol acrylamide groups capable of forming covalent bonds with both cellulose and itself.

The amount of the binder material in the paper towels of this invention will depend at least in part on the particular wipe dry properties desired. The amount of the binder material in any sheet containing the binder material will generally range from about 2 to about 10 percent by weight of dry fibers in that sheet or ply, more specifically from about 3 to about 8 weight percent and more specifically from about 3 to about 6 weight percent.

The surface area coverage of the printed binder pattern can be about 5 percent or greater, more specifically about 30 percent or greater, still more specifically from about 5 to about 90 percent, and still more specifically from about 20 to about 75 percent.

A wide variety of natural and synthetic pulp fibers are suitable for use in producing the basesheets for the products of this invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same. One example of suitable high-average length pulp fibers includes softwood fibers. Softwood pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Neenah Paper, Inc. located in Neenah, Wis. under the trade designation of "Longlac-19". An example of suitable low-average length pulp fibers are the so called hardwood pulp fibers. Hardwood pulp fibers are derived from deciduous trees and include pulp fibers such as, but not limited to, eucalyptus, maple, birch, aspen, and the like. In certain instances, eucalyptus pulp fibers may also enhance the brightness, increase the opacity, and change the pore structure of the sheet to increase its wicking ability. Moreover, if desired, secondary pulp fibers obtained from recycled materials may be used, such as fiber pulp from sources such as, for example, newsprint, reclaimed paperboard, and office waste.

In one embodiment of the invention, the paper towel product comprises a blended sheet wherein hardwood pulp fibers and softwood pulp fibers are blended prior to forming the sheet, thereby producing a homogenous distribution of hardwood pulp fibers and softwood pulp fibers in the z-direction of the sheet. In another embodiment of the invention, the paper towel product comprises a layered sheet, wherein the hardwood pulp fibers and softwood pulp fibers are layered so as to give a heterogeneous distribution of hardwood pulp fibers and softwood pulp fibers in the z-direction of the tissue sheet. More specifically, in one embodiment the hardwood pulp fibers are located in at least one of the two outer layers of the sheet and at least one of the inner layers comprises softwood pulp fibers.

The basis weight of the paper towels of this invention can be any weight suitable for paper toweling. More specifically, the basis weight of the paper towels of this invention can be from about 30 to about 90 grams per square meter (gsm), more specifically from about 40 to about 70 gsm and still more specifically from about 50 to about 65 gsm.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

DETAILED DESCRIPTION OF THE DRAWINGS

Figure 1:
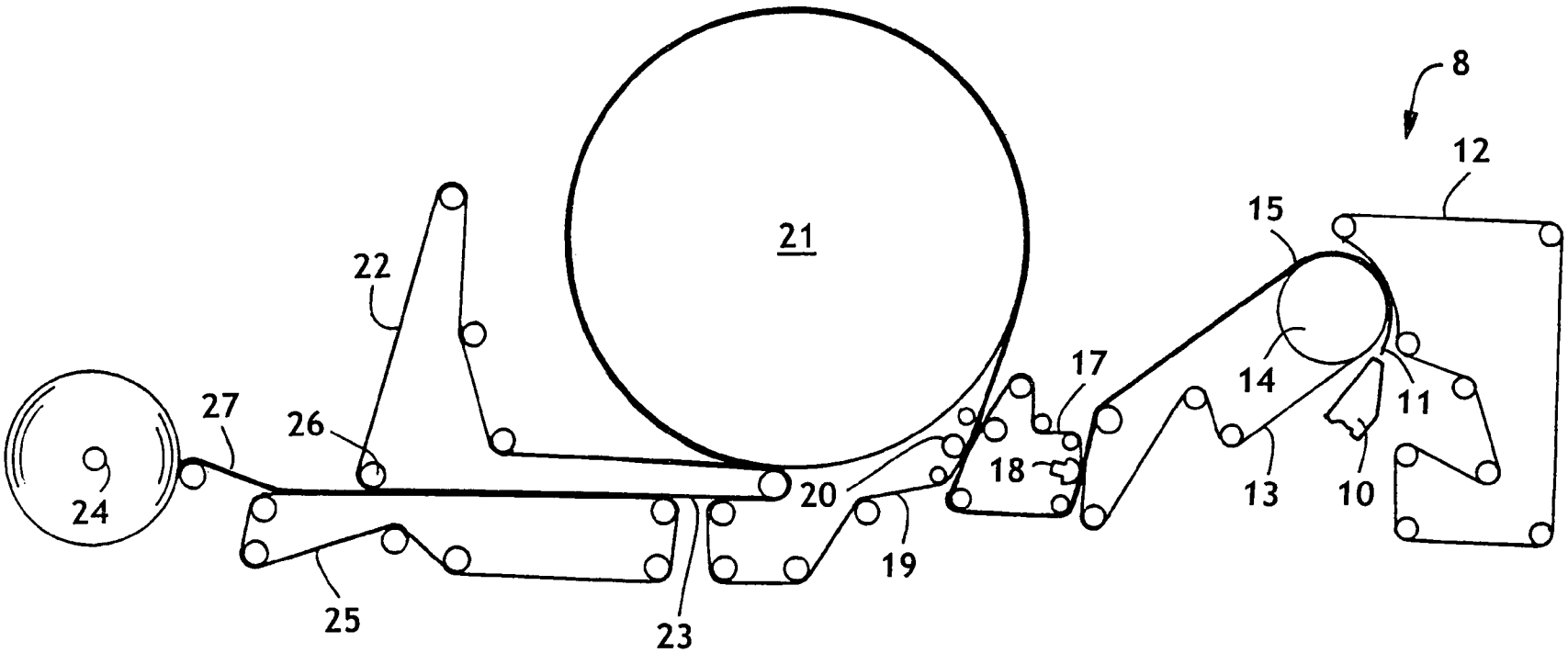
FIG. 1 is a schematic illustration of an uncreped throughdried tissue making process suitable for purposes of making basesheet plies in accordance with this invention.

FIG. 1 is a schematic illustration of an uncreped throughdried process useful for making basesheets suitable for purposes of this invention. Shown is a twin wire former 8 having a papermaking headbox 10 which injects or deposits a stream 11 of an aqueous suspension of papermaking fibers onto a plurality of forming fabrics, such as the outer forming fabric 12 and the inner forming fabric 13, thereby forming a wet tissue web 15. The forming process may be any conventional forming process known in the papermaking industry. Such formation processes include, but are not limited to, Fourdrinier formers, roof formers such as suction breast roll formers, and gap formers such as twin wire formers and crescent formers.

The wet tissue web 15 forms on the inner forming fabric 13 as the inner forming fabric 13 revolves about a forming roll 14. The inner forming fabric 13 serves to support and carry the newly-formed wet tissue web 15 downstream in the process as the wet tissue web 15 is partially dewatered to a consistency of about 10 percent based on the dry weight of the fibers. Additional dewatering of the wet tissue web 15 may be carried out by known paper making techniques, such as vacuum suction boxes, while the inner forming fabric 13 supports the wet tissue web 15. The wet tissue web 15 may be additionally dewatered to a consistency of at least about 20 percent, more specifically between about 20 to about 40 percent, and more specifically about 20 to about 30 percent. The wet tissue web 15 is then transferred from the inner forming fabric 13 to a transfer fabric 17 traveling preferably at a slower speed than the inner forming fabric 13 in order to impart increased machine direction stretch into the wet tissue web 15. The rush transfer is maintained at an appropriate level to ensure the right combination of stretch and strength in the finished product. Depending on the fabrics utilized and the post-tissue machine converting process, the rush transfer can suitably be in the range of from about 10 to about 35 percent.

The wet tissue web 15 is then transferred from the transfer fabric 17 to a throughdrying fabric 19 whereby the wet tissue web 15 may be macroscopically rearranged to conform to the surface of the throughdrying fabric 19 with the aid of a vacuum transfer roll 20 or a vacuum transfer shoe like the vacuum shoe 18. If desired, the throughdrying fabric 19 can be run at a speed slower than the speed of the transfer fabric 17 to further enhance MD stretch of the resulting absorbent sheet. The transfer may be carried out with vacuum assistance to ensure conformation of the wet tissue web 15 to the topography of the throughdrying fabric 19.

While supported by the throughdrying fabric 19, the wet tissue web 15 is dried to a final consistency of about 94 percent or greater by a throughdryer 21 and is thereafter transferred to a carrier fabric 22. Alternatively, the drying process can be any non-compressive drying method that tends to preserve the bulk of the wet tissue web 15.

The dried tissue web 23 is transported to a reel 24 using a carrier fabric 22 and an optional carrier fabric 25. An optional pressurized turning roll 26 can be used to facilitate transfer of the dried tissue web 23 from the carrier fabric 22 to the carrier fabric 25. If desired, the dried tissue web 23 may additionally be embossed to produce a pattern on the absorbent tissue product produced using the throughdrying fabric 19 and a subsequent embossing stage.

Once the wet tissue web 15 has been non-compressively dried, thereby forming the dried tissue web 23, it is possible to crepe the dried tissue web 23 by transferring the dried tissue web 23 to a Yankee dryer prior to reeling, or using alternative foreshortening methods such as micro-creping as disclosed in U.S. Pat. No. 4,919,877 issued on Apr. 24, 1990 to Parsons et al., herein incorporated by reference.

In an alternative embodiment not shown, the wet tissue web 15 may be transferred directly from the inner forming fabric 13 to the throughdrying fabric 19, thereby eliminating the transfer fabric 17. The throughdrying fabric 19 may be traveling at a speed less than the inner forming fabric 13 such that the wet tissue web 15 is rush transferred or, in the alternative, the throughdrying fabric 19 may be traveling at substantially the same speed as the inner forming fabric 13.

Figure 2:
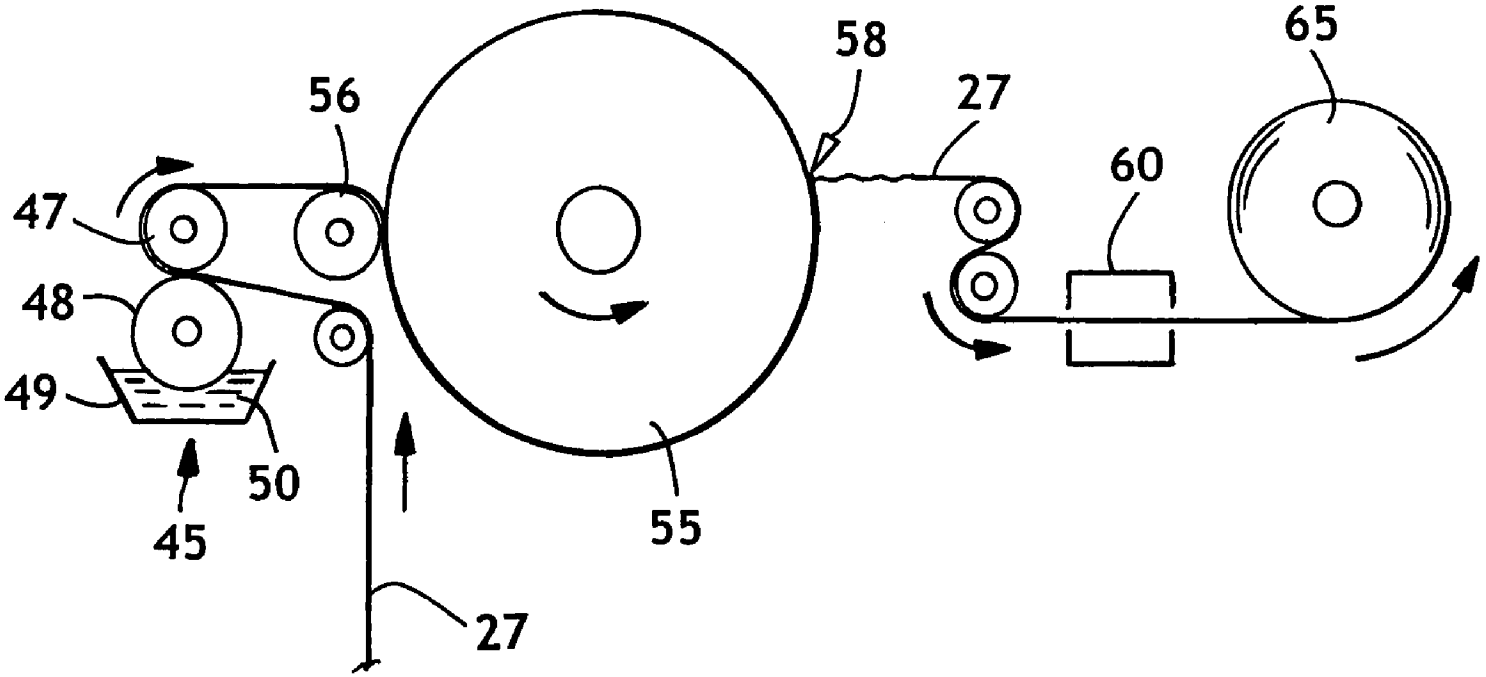
FIG. 2 is a schematic illustration of a print/crepe method of applying binder material to the basesheet made by the process of FIG. 1 in accordance with this invention.

FIG. 2 is a schematic representation of a print/crepe process in which a binder material is applied to one outer surface of the throughdried basesheet as produced in accordance with FIG. 1. Although gravure printing of the binder is illustrated, other means of applying the binder material can also be used, such as foam application, spray application, flexographic printing, or digital printing methods such as ink jet printing and the like. Shown is paper sheet 27 passing through a binder material application station 45. Station 45 includes a transfer roll 47 in contact with a rotogravure roll 48, which is in communication with a reservoir 49 containing a suitable binder 50. The binder material 50 is applied to one side of the sheet in a pre-selected pattern. After the binder material is applied, the sheet is adhered to a creping roll 55 by a press roll 56. The sheet is carried on the surface of the creping roll for a distance and then removed therefrom by the action of a creping blade 58. The creping blade performs a controlled pattern creping operation on the side of the sheet to which the binder material was applied.

Once creped, the sheet 27 is pulled through an optional drying station 60. The drying station can include any form of a heating unit, such as an oven energized by infrared heat, microwave energy, hot air or the like. Alternatively, the drying station may comprise other drying methods such as photocuring, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the binder material. Depending upon the binder material selected, however, drying station 60 may not be needed. Once passed through the drying station, the sheet can be wound into a roll 65.

Figure 3:
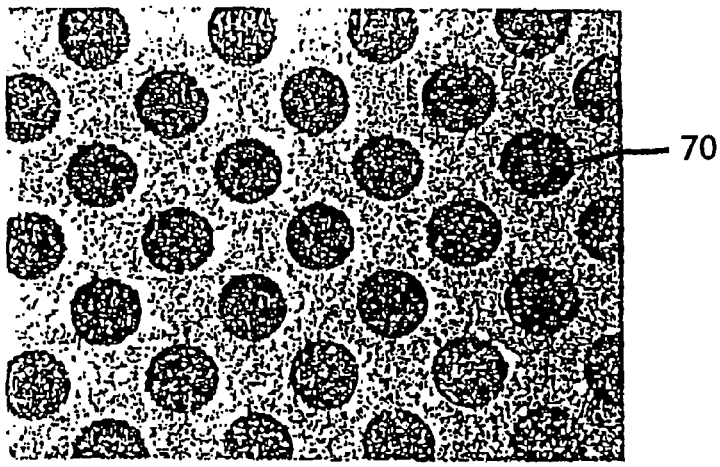
FIG. 3 is a representation of a binder material pattern (dot pattern) which can be applied to the basesheet.

FIG. 3 shows one embodiment of a print pattern that can be used for applying a binder material to a paper sheet in accordance with this invention. As illustrated, the pattern represents a succession of discrete dots 70. In one embodiment, for instance, the dots can be spaced so that there are approximately from about 25 to about 35 dots per inch (25.4 mm) in the machine direction and/or the cross-machine direction. The dots can have a diameter, for example, of from about 0.01 inch (0.25 mm) to about 0.03 inch (0.76 mm). In one particular embodiment, the dots can have a diameter of about 0.02 inch (0.51 mm) and can be present in the pattern so that approximately 28 dots per inch (25.4 mm) extend in both the machine direction and the cross-machine direction. Besides dots, various other discrete shapes such as elongated ovals or rectangles can also be used when printing the binder material onto the sheet.

Figure 4:
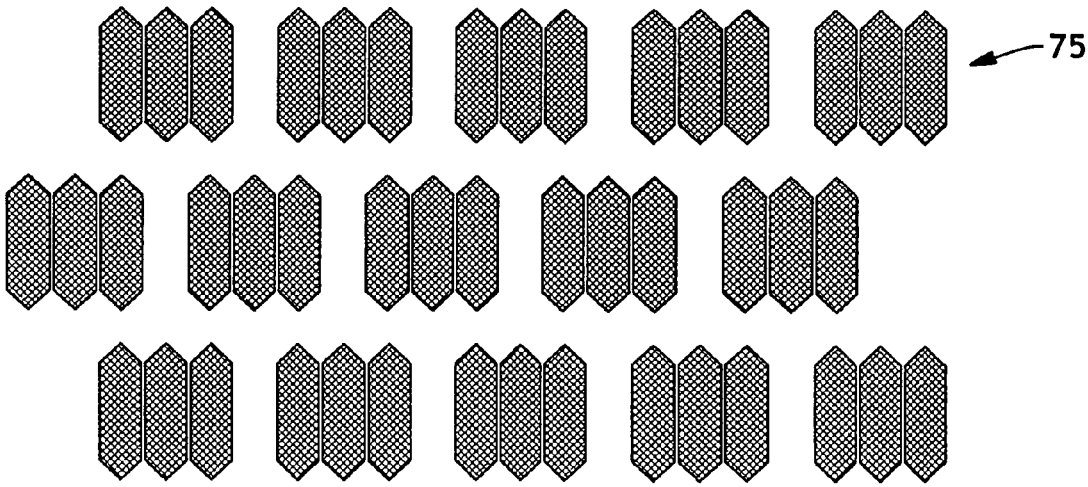
FIG. 4 is a representation of an alternative binder material pattern (hexagonal element pattern) which can be applied to the basesheet.

FIG. 4 shows a print pattern in which the binder material print pattern is made up of discrete multiple deposits 75 that are each comprised of three elongated hexagons. In one embodiment, each hexagon can be about 0.02 inch (0.51 mm) long and can have a width of about 0.006 inch (0.15 mm). Approximately 35 to 40 deposits per inch (25.4 mm) can be spaced in the machine direction and the cross-machine direction.

Figure 5:
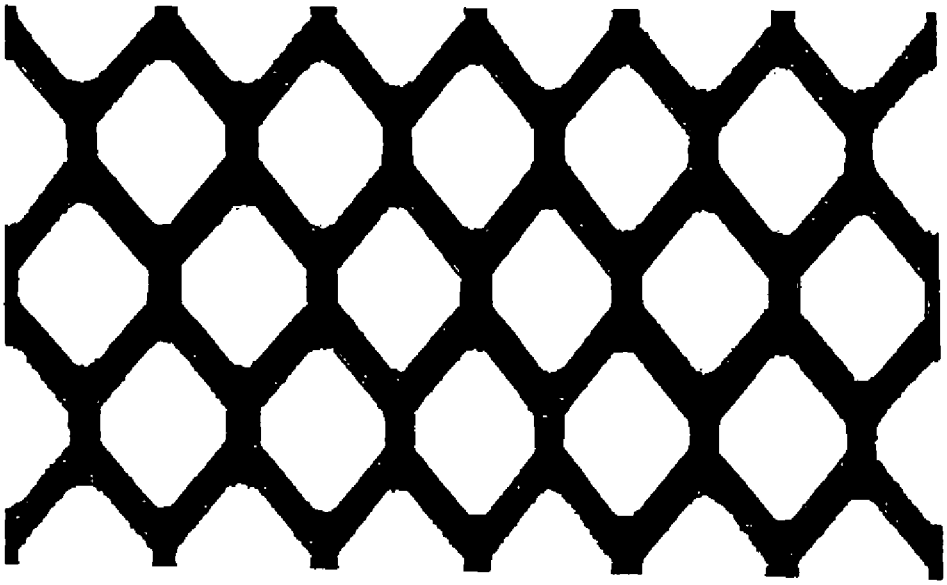
FIG. 5 is a representation of an alternative binder material pattern (reticulated pattern) that can be applied to the basesheet.

FIG. 5 illustrates an alternative binder material pattern in which the binder material is printed onto the sheet in a reticulated pattern. The dimensions are similar to those of the dot pattern of FIG. 3. Reticulated patterns, which provide a continuous network of binder material, may result in relatively greater sheet strength than comparable patterns of discrete elements, such as the dot pattern of FIG. 3. It will be appreciated that many other patterns, in addition to those illustrated above, can also be used depending on the desired properties of the final product.

Figure 6:
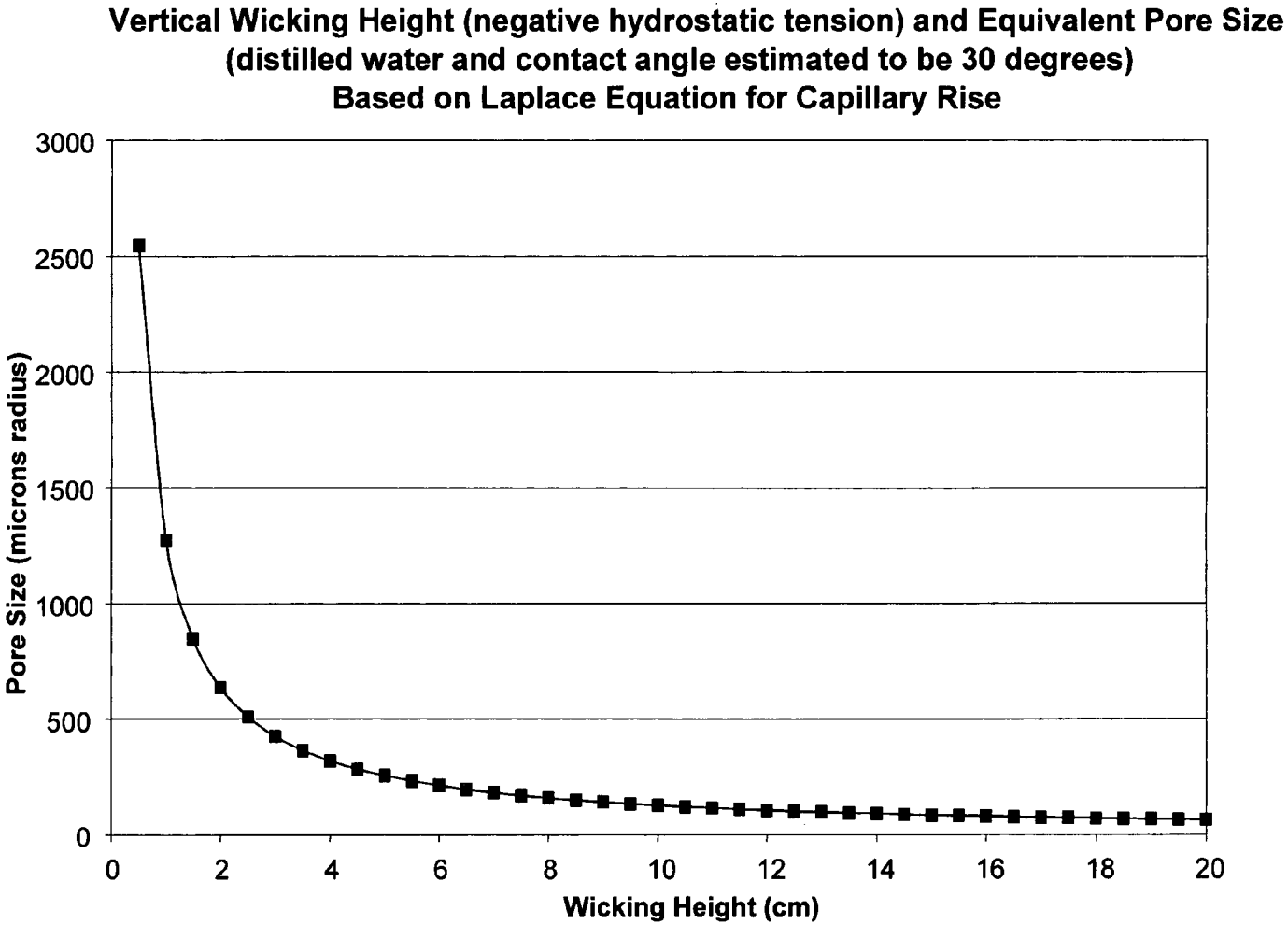
FIG. 6 is a plot correlating the wicking height and pore size when carrying out the vertical wicking testing described herein.
Figure 7:
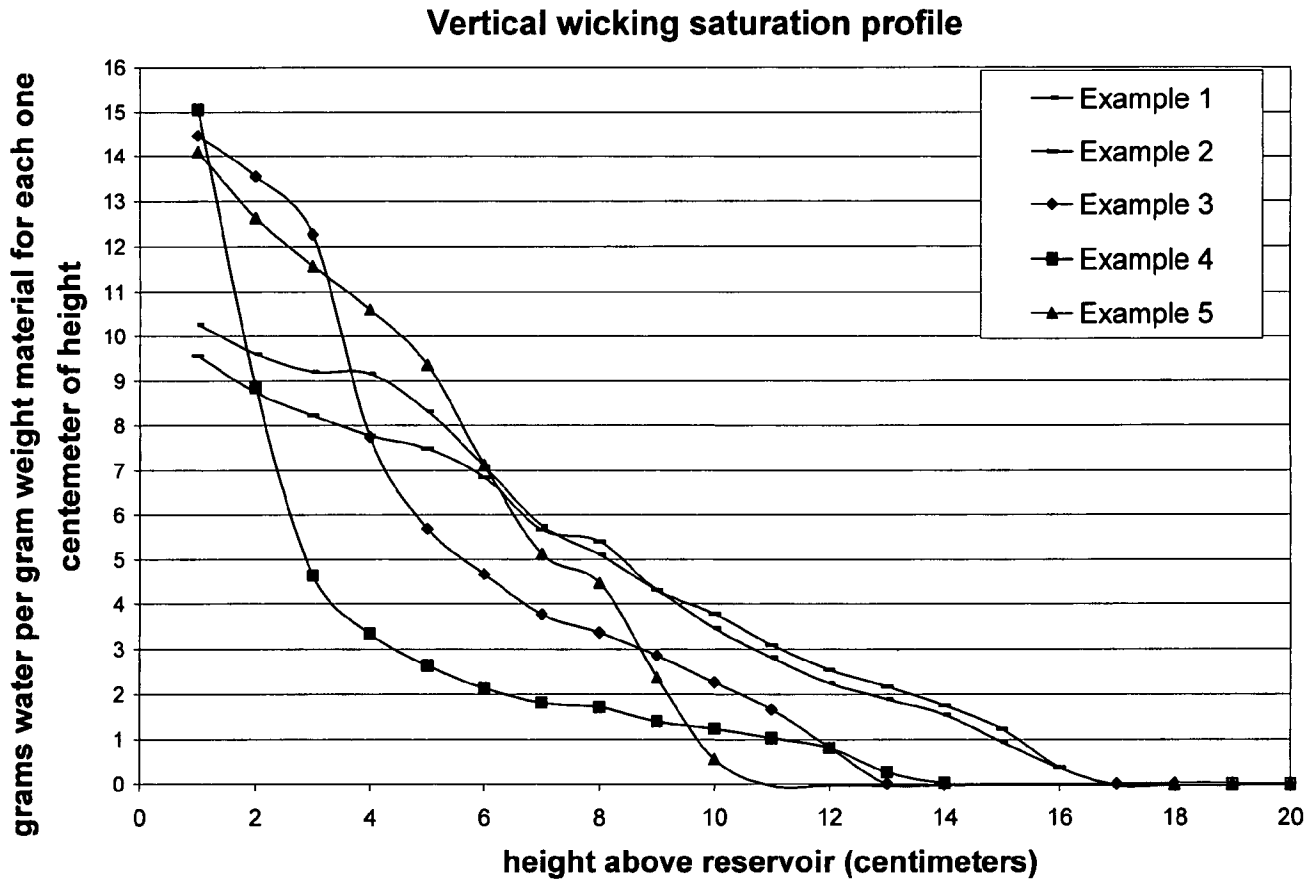
FIG. 7 is a plot of the vertical wicking saturation profile for the examples of the products of this invention and the comparative examples (See Examples 1-5).
Figure 8:
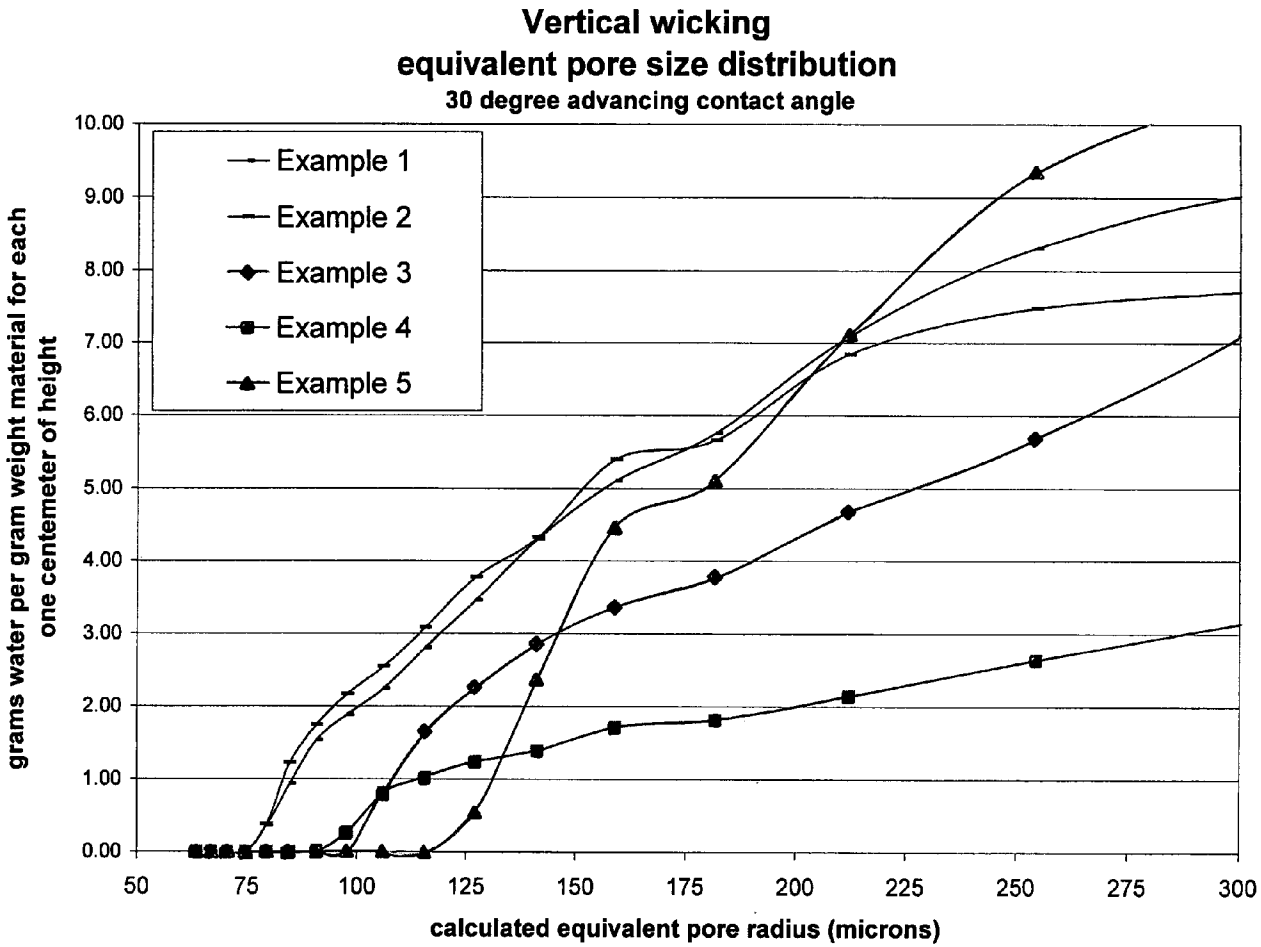
FIG. 8 is a plot of the vertical wicking equivalent pore size distribution for the examples of this invention and the comparative examples.

FIGS. 6-8 are plots pertaining to the vertical wicking properties of the towels of this invention and the comparative towels as described in connection with the Examples.

Test Methods

As used herein, the "wipe dry test" is determined as described in U.S. Pat. No. 4,096,311 entitled "Wipe Dry Improvement of Non-woven Dry-Formed Webs", issued Jun. 20, 1978 to Pietreniak, herein incorporated by reference. More specifically, the method used to measure the wipe dry capability of paper towels for liquid spills includes the following steps.

1. A sample of towel being tested is mounted on a padded surface of a sled (10 cm×6.3 cm).
2. The sled is mounted on an arm designed to traverse the sled across a rotating disk.
3. The sled is weighted so that the combined weight of the sled and sample is about 770 grams.
4. The sled and traverse arm are positioned on a horizontal rotatable disc with the sample being pressed against the surface of the disc by the weighted sled (the sled and traverse arm being positioned with the leading edge of the sled (6.3 cm side) just off the center of the disc and with the 10 cm centerline of the sled being positioned along a radial line of the disc so that the trailing 6.3 cm edge is positioned near the perimeter of the disc).
5. Dispense 0.5 ml of test solution on the center of the disc in front of the leading edge of the sled. Sufficient surfactant is added to the water so that it leaves a film when wiped rather than discrete droplets. For this test, a 0.0125% Tergitol 15-S-15 solution was used.
6. The disc having a diameter of about 60 cm is rotated at about 65 rpm while the traverse arm moves the sled across the disc at a speed of about 1.27 cm per table revolution until the trailing edge of the sled crosses off the outer edge of the disc, at which point the test is stopped. From start to finish of the test takes approximately 20 seconds.
7. The wiping effect of the test sample upon the test solution is observed during the test as the sled wipes across the disc, in particular the wetted surface is observed and a wiped dry area appears at the center of the disc and enlarges radially on the disc.
8. At the moment the test is stopped (when the trailing edge of the sled passes off the edge of the disc) the size of the wiped dry area in square centimeters at the center of the disc is observed (if any) and recorded. To aid in the observation of the size of the area on the disc wiped dry by the test sample, concentric circular score lines are made on the surface of the disc corresponding to 50, 100, 200, 300, 400, 500, and 750 $cm^2$ circles so that the size of the dry area can be quickly determined by visually comparing the dry area to a reference score line of known area.

The test is performed under constant temperature and relative humidity conditions (21° C.+/−1° C., 65% relative humidity +/−2%). The test is performed 10 times for each sample (5 times each with the outside and inside towel surfaces against the rotating surface). The average of 5 measurements for each surface is determined and reported as the wipe dry index in square centimeters for that surface of the sample being tested.

As used herein, the "machine direction (MD) tensile strength" represents the peak load per sample width when a sample is pulled to rupture in the machine direction. In comparison, the cross-machine direction (CD) tensile strength represents the peak load per sample width when a sample is pulled to rupture in the cross-machine direction. Unless specified otherwise, tensile strengths are dry tensile strengths.

Samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks® for Windows Ver. 3.10 or current version 4.07B (MTS Systems Corp., Research Triangle Park, N.C.). The load cell is selected from either a 50 Newton or 100 Newton maximum, depending on the strength of the sample being tested, such that the majority of peak load values fall between 10-90 percent of the load cell's full scale value. The gauge length between jaws is 4+/−0.04 inches (101.6+/−mm). The jaws are operated using pneumatic action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product and the arithmetic average of all individual specimen tests is either the MD or CD tensile strength for the product.

Wet tensile strength measurements are measured in the same manner, but are only typically measured in the cross-machine direction of the sample. Prior to testing, the center portion of the CD sample strip is saturated with room temperature distilled water immediately prior to loading the specimen into the tensile test equipment. CD wet tensile measurements can be made both immediately after the product is made and also after some time of natural aging of the product. For mimicking natural aging, experimental product samples are stored at ambient conditions of approximately 23° C. and 50% relative humidity for up to 15 days or more prior to testing so that the sample strength no longer increases with time. Following this natural aging step, the samples are individually wetted and tested. Alternatively, samples may be tested immediately after production with no additional aging time. For these samples, the tensile strips are artificially aged for 5 or 10 minutes in an oven at 105° C. prior to testing. Following this artificial aging step, the samples are individually wetted and tested. For measuring samples that have been made more than two weeks prior to testing, which are inherently naturally aged, such conditioning is not necessary.

Sample wetting is performed by first laying a single test strip onto a piece of blotter paper (Fiber Mark, Reliance Basis 120). A pad is then used to wet the sample strip prior to testing. The pad is a Scotch-Brite® brand (3M) general purpose commercial scrubbing pad. To prepare the pad for testing, a full-size pad is cut approximately 2.5 inches (63.5 mm) long by 4 inches (101.6 mm) wide. A piece of masking tape is wrapped around one of the 4 inch (101.6 mm) long edges. The taped side then becomes the "top" edge of the wetting pad. To wet a tensile strip, the tester holds the top edge of the pad and dips the bottom edge in approximately 0.25 inch (6.35 mm) of distilled water located in a wetting pan. After the end of the pad has been saturated with water, the pad is then taken from the wetting pan and the excess water is removed from the pad by lightly tapping the wet edge three times on a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry tensile tests, the characterization of a product is determined by the average of six representative sample measurements.

In addition to tensile strength, stretch, slope and tensile energy absorbed (TEA) is also reported by the MTS TestWorks® for Windows Ver. 3.10 or 4.07B program for each sample measured. Stretch (either MD stretch or CD stretch) is reported as a percentage and is defined as the ratio of the slack-corrected elongation of a specimen at the point it generates its peak load divided by the slack-corrected gauge length. Slope is reported in the units of grams (g) or kilograms (kg) and is defined as the gradient of the least-squares line fitted to the load-corrected strain points falling between a specimen-generated force of 70 to 157 grams (0.687 to 1.540 N) divided by the specimen width.

Total energy absorbed (TEA) is calculated as the area under the stress-strain curve during the same tensile test as has previously described above. The area is based on the strain value reached when the sheet is strained to rupture and the load placed on the sheet has dropped to 65 percent of the peak tensile load. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per centimeter and the area calculated by integration. The units of strain are centimeters per centimeter so that the final TEA units become g-cm/cm$^2$.

As used herein, the sheet "caliper" is the representative thickness of a single sheet measured on a stack of ten sheets in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the sheet "bulk" is calculated as the quotient of the "caliper", expressed in microns, divided by the air-dry basis weight, expressed in grams per square meter. The resulting sheet bulk is expressed in cubic centimeters per gram.

As used herein "vertical wicking" represents a saturation profile following a wicking test as described below. Vertical wicking occurs as a result of the material having a characteristic capillary absorption potential. At equilibrium conditions of vertical wicking a saturation profile or curve is exhibited from the point of contact with liquid to the height of the advancing fluid front. This curve can be expressed as saturation (in this case grams liquid per gram of material) as a function of height. The greater the saturation at higher heights the greater the absorbent potential to draw in and hold liquid.

Wicking is commonly interrelated with flow in a capillary or hollow tube. The Laplace equation is a model for capillary driven flow where $R$ = capillary radius $\gamma$ = liquid surface tension $\theta$ = liquid/solid contact angle $\rho$ = liquid density $g$ = acceleration due to gravity $h$ = height of liquid column $$h = \frac{2\gamma\cos\theta}{\rho g R}$$

Towels can be thought of as a collection or distribution of pores. Knowing the heights liquid can wick one can use this model to equate pore radius at each height. Thus a wicking saturation profile calculated through this transformation can be expressed as saturation as a function of equivalent pore radius. FIG. 6 is a plot showing the relationship between wicking height and pore size when applying the Laplace mathematical model for capillary rise to the vertical wicking test described herein.

To conduct a vertical wicking test, a length of tissue is suspended and allowed to hang vertically above a reservoir of water with the bottom portion of the sample submerged in the reservoir. The sample is allowed to wick or absorb liquid until an equilibrium condition is reached. There are numerous means to obtain a saturation curve following vertical wicking. One such method is to cut and weigh segments of the sample as described by Vertical Wicking Absorbent Capacity in the TEST METHODS section of U.S. Pat. No. 5,387,207 to Dyer et al, issued Feb. 7, 1995, which is hereby incorporated by reference. To obtain the saturation results in the following examples, the use of x-ray densitometry was utilized as described by the "X-ray imaging test" in the TEST METHODS section of U.S. Pat. No. 5,843,063 to Anderson et al, issued Dec. 1, 1998, which is hereby incorporated by reference. Lengths of towels are suspended vertically above a reservoir of water situated in an x-ray chamber with the beam parallel to the horizon at TAPPI conditions. After two hours, a digital gray scale x-ray image is collected of the wicking event. Using image analysis, having previously calibrated saturation as a function of gray scale, a saturation profile indicating grams of fluid for one centimeter segments of height (for example 6 cm would represent that segment between 5 and 6 cm above the water surface) is generated. Saturation is then expressed as grams water per dry weight of material.

EXAMPLES

Example 1 (Invention)

A pilot tissue machine was used to produce a layered, uncreped throughdried tissue basesheet generally as described in FIG. 1. More specifically, the basesheet was made using a three-layered headbox with a 25/50/25 layer fiber weight split. The fibers in each layer were 100 percent northern softwood kraft fibers (LL-19). The air-side layer had 7.5 kilograms per metric tonne (kg/MT) of ProSoft® TQ1003 debonder and 6.0 kg/MT of Kymene® 557 LX added to it. The center layer had 7.5 kg/MT of ProSoft® TQ 1003 debonder and 3.0 kg/MT of Kymene® 557 LX added to it. The fabric side layer had 2 kg/MT carboxymethylcellulose (CMC) and 8 kg/MT of Kymene® 557 LX added to it and the fibers in this layer were refined at 2.0 horsepower day per metric tonne.

The machine-chest furnish containing the fibers was diluted to approximately 0.2 percent consistency and delivered to a layered headbox. The forming fabric speed was approximately 1375 feet per minute (fpm) (419 meters per minute). The basesheet was then rush transferred to a transfer fabric (Voith Fabrics, t1207-6) traveling 15% slower than the forming fabric using a vacuum roll to assist the transfer. At a second vacuum-assisted transfer, the basesheet was transferred onto the throughdrying fabric (Voith Fabrics, t1207-6). The sheet was dried with a throughdryer resulting in a basesheet having an air-dry basis weight of about 44.5 grams per square meter (gsm) and rolled into a parent roll for subsequent post treatment and converting.

The basesheet was unwound from the parent roll and fed to a gravure printing line and treated as shown in FIG. 2 where a latex binder material was printed onto the air-side layer of the sheet using direct rotogravure printing. The binder material in this example was Airflex® 426, which was obtained from Air Products and Chemicals, Inc. of Allentown, Pa. The binder material formulation contained the following ingredients:

Latex

| | |
|---|---|
| 1. Airflex ® 426 (63.2% solids) | 27,680 g |
| 2. Defoamer (Nalco 7565) | 176 g |
| 3. Water | 19,200 g |

Reactant

| | |
|---|---|
| 1. Kymene ® 557LX (12.5% solids) | 8,770 g |
| 2. Parez ® 631 NC | 7,310 g |

pH Adjustment

| | |
|---|---|
| 1. NaOH (10% solids) | 1,025 g |

The reactant ingredients (Kymene and Parez) and pH adjustment chemistry were added directly to the Latex mixture under agitation. After all ingredients had been added, the print fluid was allowed to mix for approximately 5-30 minutes prior to use in the gravure printing operation. For this binder formulation, the weight percent ratio of azetidinium-functional polymer based on carboxylic acid-functional polymer was 6.3%. The viscosity of the print fluid was 60 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The oven-dry solids of the print fluid was 29.7 weight percent. The print fluid pH was 6.0.

The sheet was gravure printed with the binder material in a 28 mesh "dot" pattern as shown in FIG. 3 wherein 28 dots per inch, each dot having a diameter of 0.020" (0.508 mm), were printed on the sheet in both the machine and cross-machine directions. The resulting add-on was approximately 3.7 weight percent based on the dry weight of the fiber in sheet.

The printed sheet was then pressed against and creped off of a rotating drum, which had a surface temperature of 107° C. and wound into a parent roll. Thereafter, the resulting print/creped sheet was converted into a roll of paper towels containing 55 sheets.

Example 2 (Invention)

A roll of paper towels was made as described in Example 1, except the basesheet was made using a three-layered headbox with a 20/50/30 layer fiber weight split with 20% of the fiber in the fabric layer, 50% in the center layer and 30% in the air layer. The fibers in each layer were 100 percent northern softwood kraft fibers (LL-19). The air-side layer had 10.0 kg/MT of ProSoft® TQ1003 debonder and 5.0 kg/MT of Kymene® 557 LX added to it. The center layer had 10.0 kg/MT of ProSoft® TQ 1003 debonder and 3.0 kg/MT of Kymene® 557 LX added to it. The fabric side layer had 2 kg/MT carboxymethylcellulose (CMC) and 5 kg/MT of Kymene® 557 LX added to it and the fibers in this layer were refined at 2.0 horsepower day per metric tonne. The basesheet was then unwound, printed and creped as previously described in Example 1.

Example 3 (Comparative)

A commercial Kleenex® Viva® paper towel produced using a wetlaid process which was obtained in 2004.

Example 4 (Comparative)

A commercial Bounty® paper towel produced using a wetlaid process which was obtained in 2003.

Example 5 (Comparative)

A commercial Kleenex® Viva® paper towel produced using an airlaid process which was obtained in 2004.

A summary of the physical properties of the paper towels of the Examples is set forth in Tables 1 and 2 below.

TABLE 1

| Test | Units | Example 1 (Invention) | Example 2 (Invention) | Example 3 (Comparative | Example 4 (Comparative) | Example 5 (Comparative) |
|---|---|---|---|---|---|---|
| Basis Weight (bone dry) | gsm | 55.79 | 56.47 | 61.96 | 38.20 | 54.94 |
| Caliper (10 sheet) | mm | 6.45 | 6.96 | 6.73 | 5.92 | 7.19 |
| Stack Bulk | $g/cm^3$ | 10.82 | 11.59 | 10.24 | 14.50 | 12.4 |
| MD Tensile | g/7.62 cm | 1925 | 1711 | 1488 | 2976 | 2036 |
| MD Stretch | % | 36.3 | 35.3 | 22.0 | 16.2 | 11.6 |
| MD TEA | $g\text{-}cm/cm^2$ | 44.4 | 40.4 | 25.1 | 38.4 | 23.9 |
| MD slope | kg | 4.2 | 4.3 | 5.5 | 16.1 | 15.4 |
| CD Tensile | g/7.62 cm | 1398 | 1254 | 908 | 2213 | 1468 |
| CD Stretch | % | 18.4 | 17.8 | 17.1 | 12.7 | 16.9 |
| CD TEA | $g\text{-}cm/cm^2$ | 23.3 | 21.2 | 16.5 | 25.5 | 22.4 |
| CD slope | kg | 6.8 | 6.5 | 5.2 | 15.6 | 6.9 |
| CD Wet Tensile | g/7.62 cm | 788 | 695 | 657 | 763 | 963 |
| CD Wet Stretch | % | 13.2 | 13.2 | 14.6 | 8.9 | 13.1 |

TABLE 2

| Test Description | Example 1 (Invention) Wipe Dry ($cm^2$) | Example 2 (Invention) Wipe Dry ($cm^2$) | Example 3 (Comparative) Wipe Dry ($cm^2$) | Example 4 (Comparative) Wipe Dry ($cm^2$) | Example 5 (Comparative) Wipe Dry ($cm^2$) |
|---|---|---|---|---|---|
| Outside of roll towel surface (n = 5) | 1000 | 1000 | 520 | 367 | 133 |
| Inside of roll towel surface (n = 5) | 800 | 830 | 460 | 400 | 20 |

TABLE 2-continued

| Test Description | Example 1 (Invention) Wipe Dry ($cm^2$) | Example 2 (Invention) Wipe Dry ($cm^2$) | Example 3 (Comparative) Wipe Dry ($cm^2$) | Example 4 (Comparative) Wipe Dry ($cm^2$) | Example 5 (Comparative) Wipe Dry ($cm^2$) |
|---|---|---|---|---|---|
| AVERAGE of two sides (n = 10) | 900 | 915 | 490 | 384 | 76 |

Tables 3 and 4 below, which correspond to FIGS. 7 and 8, respectively, set forth the vertical wicking data for all of the Examples. The data in Table 3 and the corresponding plot of FIG. 7 illustrate that the towels of this invention contain significant amounts of wicked water against a negative hydrostatic tension of 10-16 centimeters.

TABLE 3

| Negative hydrostatic tension (cm of water) | Example 1 gram per gram saturation | Example 2 gram per gram saturation | Example 3 gram per gram saturation | Example 4 gram per gram saturation | Example 5 gram per gram saturation |
|---|---|---|---|---|---|
| 20 | 0.00 | 0.00 | 0.00 | 0.00 | 0.00 |
| 19 | 0.00 | 0.00 | 0.00 | 0.00 | 0.00 |
| 18 | 0.00 | 0.00 | 0.00 | 0.00 | 0.00 |
| 17 | 0.00 | 0.00 | 0.00 | 0.00 | 0.00 |
| 16 | 0.36 | 0.37 | 0.00 | 0.00 | 0.00 |
| 15 | 0.94 | 1.22 | 0.00 | 0.00 | 0.00 |
| 14 | 1.54 | 1.75 | 0.00 | 0.02 | 0.00 |
| 13 | 1.89 | 2.16 | 0.00 | 0.26 | 0.00 |
| 12 | 2.24 | 2.55 | 0.82 | 0.81 | 0.00 |
| 11 | 2.81 | 3.09 | 1.66 | 1.02 | 0.00 |
| 10 | 3.46 | 3.78 | 2.26 | 1.24 | 0.55 |
| 9 | 4.30 | 4.32 | 2.86 | 1.40 | 2.38 |
| 8 | 5.10 | 5.40 | 3.36 | 1.72 | 4.48 |
| 7 | 5.76 | 5.67 | 3.76 | 1.82 | 5.12 |
| 6 | 7.09 | 6.85 | 4.67 | 2.14 | 7.12 |
| 5 | 8.32 | 7.48 | 5.69 | 2.64 | 9.35 |
| 4 | 9.16 | 7.78 | 7.74 | 3.34 | 10.61 |
| 3 | 9.21 | 8.22 | 12.25 | 4.64 | 11.58 |
| 2 | 9.60 | 8.74 | 13.54 | 8.87 | 12.62 |
| 1 | 10.27 | 9.56 | 14.46 | 15.06 | 14.10 |

The data in Table 4 and the corresponding plot of FIG. 8 demonstrate that the towels of this invention contain significant amounts of wicked water in pores having a potential of capillaries having a radius of 100 microns or less.

TABLE 4

| Equivalent pore radius | Example 1 gram per gram saturation | Example 2 gram per gram saturation | Example 3 gram per gram saturation | Example 4 gram per gram saturation | Example 5 gram per gram saturation |
|---|---|---|---|---|---|
| 64 | 0.00 | 0.00 | 0.00 | 0.00 | 0.00 |
| 67 | 0.00 | 0.00 | 0.00 | 0.00 | 0.00 |
| 71 | 0.00 | 0.00 | 0.00 | 0.00 | 0.00 |
| 75 | 0.00 | 0.00 | 0.00 | 0.00 | 0.00 |
| 80 | 0.36 | 0.37 | 0.00 | 0.00 | 0.00 |
| 85 | 0.94 | 1.22 | 0.00 | 0.00 | 0.00 |
| 91 | 1.54 | 1.75 | 0.00 | 0.02 | 0.00 |
| 98 | 1.89 | 2.16 | 0.00 | 0.26 | 0.00 |
| 106 | 2.24 | 2.55 | 0.82 | 0.81 | 0.00 |
| 116 | 2.81 | 3.09 | 1.66 | 1.02 | 0.00 |
| 127 | 3.46 | 3.78 | 2.26 | 1.24 | 0.55 |
| 141 | 4.30 | 4.32 | 2.86 | 1.40 | 2.38 |
| 159 | 5.10 | 5.40 | 3.36 | 1.72 | 4.48 |
| 182 | 5.76 | 5.67 | 3.76 | 1.82 | 5.12 |
| 212 | 7.09 | 6.85 | 4.67 | 2.14 | 7.12 |

TABLE 4-continued

| Equivalent pore radius | Example 1 gram per gram saturation | Example 2 gram per gram saturation | Example 3 gram per gram saturation | Example 4 gram per gram saturation | Example 5 gram per gram saturation |
|---|---|---|---|---|---|
| 254 | 8.32 | 7.48 | 5.69 | 2.64 | 9.35 |
| 318 | 9.16 | 7.78 | 7.74 | 3.34 | 10.61 |
| 424 | 9.21 | 8.22 | 12.25 | 4.64 | 11.58 |
| 636 | 9.60 | 8.74 | 13.54 | 8.87 | 12.62 |
| 1272 | 10.27 | 9.56 | 14.46 | 15.06 | 14.10 |

It will be appreciated that the foregoing examples, given for purposes of illustration, are not to be construed as limiting the scope of this invention, which is defined by the following claims and all equivalents thereto.

We claim:

1. A paper towel comprising a throughdried sheet having an air-side and a fabric-side, said throughdried sheet having a creped application of a binder material on only the air-side of the sheet, said binder material comprising an unreacted mixture of an azetidinium-reactive polymer and an azetidinium-functional cross-linking polymer, wherein the amount of the azetidinium-functional cross-linking polymer relative to the amount of the azetidinium-reactive polymer is from about 0.5 to about 25 dry weight percent on a solids basis, said paper towel having an average wipe dry test value of about 900 square centimeters or greater and a cross-machine direction tensile strength from about 1000 to about 2000 grams per 7.62 centimeters.

2. The paper towel of claim 1 having a wipe dry test value of from about 900 to about 1000 square centimeters.

3. The paper towel of claim 1 having a wipe dry test value of from about 900 to about 950 square centimeters.

4. The paper towel of claim 1 having a single ply.

5. The paper towel of claim 1 having two plies.

6. The paper towel of claim 1 wherein the add-on amount of the binder material is from about 2 to about 10 weight percent based on the amount of dry fiber.

7. The paper towel of claim 1 wherein the surface area coverage of the binder material is from about 5 to about 90 percent.

8. The paper towel of claim 1 wherein the binder material is applied in a reticulated print pattern.

9. The paper towel of claim 1 wherein the binder material is applied in a dot pattern.

10. The paper towel of claim 1 having a pore structure characterized by a grams of water per gram of product saturation of about 1.0 or greater for pores having an equivalent pore radius of about 100 microns or less, as determined by the vertical wicking test.

11. The paper towel of claim 1 having a cross-machine direction tensile strength from about 1200 to about 1500 grams per 7.62 centimeters.

12. The paper towel of claim 1 having a pore structure characterized by a grams of water per gram of product saturation of about 2.0 or greater for pores having an equivalent pore radius of about 100 microns or less, as determined by the vertical wicking test.

13. The paper towel of claim 1 having a pore structure characterized by a grams of water per gram of product saturation of from about 0.3 to about 2.0 for pores having an equivalent pore radius from about 80 to about 100 microns, as determined by the vertical wicking test.

14. The paper towel of claim 1 having a pore structure capable of absorbing at least 0.3 grams of water per gram of product against a negative hydrostatic tension of about 16 centimeters of water, as determined by the vertical wicking test.

15. The paper towel of claim 1 having a pore structure capable of absorbing at least 1.0 gram of water per gram of product against a negative hydrostatic tension of about 15 centimeters of water, as determined by the vertical wicking test.

16. A paper towel having a pore structure characterized by a grams of water per gram of product saturation of about 1.0 or greater for pores having an equivalent pore radius of about 100 microns or less, as determined by the vertical wicking test.

17. The paper towel of claim 16 having a pore structure characterized by a grams of water per gram of product saturation of about 2.0 or greater for pores having an equivalent pore radius of about 100 microns or less, as determined by the vertical wicking test.

18. The paper towel of claim 16 having a pore structure characterized by a grams of water per gram of product saturation of from about 0.3 to about 2.0 for pores having an equivalent pore radius from about 80 to about 100 microns, as determined by the vertical wicking test.

19. The paper towel of claim 16 having a pore structure capable of absorbing at least 0.3 grams of water per gram of product against a negative hydrostatic tension of about 16 centimeters of water, as determined by the vertical wicking test.

20. The paper towel of claim 16 having a pore structure capable of absorbing at least 1.0 gram of water per gram of product against a negative hydrostatic tension of about 15 centimeters of water, as determined by the vertical wicking test.

21. The paper towel of claim 16 having a pore structure capable of absorbing at least 1.5 grams of water per gram of product against a negative hydrostatic tension of about 14 centimeters of water, as determined by the vertical wicking test.

* * * * *